US006989757B2

(12) United States Patent
Geoffrey J. et al.

(10) Patent No.: US 6,989,757 B2
(45) Date of Patent: Jan. 24, 2006

(54) PROACTIVE CARBON MONOXIDE MONITORING, ALARM AND PROTECTION SYSTEM

(75) Inventors: Winters Geoffrey J., Greenwich, CT (US); Marquis James A., Danbury, CT (US)

(73) Assignee: Electronic Control Systems, LLC, Norwalk, CT (US)

( * ) Notice: Subject to any disclaimer, the term of this patent is extended or adjusted under 35 U.S.C. 154(b) by 32 days.

(21) Appl. No.: 10/188,283

(22) Filed: Jul. 1, 2002

(65) Prior Publication Data

US 2003/0020619 A1 Jan. 30, 2003

Related U.S. Application Data

(60) Provisional application No. 60/302,439, filed on Jun. 29, 2001.

(51) Int. Cl.
*G08B 17/10* (2006.01)

(52) U.S. Cl. ..... 340/632; 340/628; 340/506; 340/524

(58) Field of Classification Search ..... 340/632, 340/628, 605, 692, 539.1, 506, 524, 525; 200/61.03
See application file for complete search history.

(56) References Cited

U.S. PATENT DOCUMENTS 4,141,007 A * 2/1979 Kavasilios et al. ..... 340/500
4,282,519 A * 8/1981 Haglund et al. ..... 340/628
4,659,909 A * 4/1987 Knutson ..... 219/446.1
4,851,823 A * 7/1989 Mori ..... 340/691.1
5,576,739 A 11/1996 Murphy ..... 340/825.06
5,793,296 A * 8/1998 Lewkowicz ..... 340/632
6,025,788 A * 2/2000 Diduck ..... 340/870.16
6,046,441 A * 4/2000 Daffron ..... 219/506
6,097,289 A * 8/2000 Li et al. ..... 340/531
6,130,412 A * 10/2000 Sizemore ..... 219/481
6,144,310 A * 11/2000 Morris ..... 340/692
6,426,703 B1 * 7/2002 Johnston et al. ..... 340/628
6,552,647 B1 * 4/2003 Thiessen et al. ..... 340/3.1
6,600,424 B1 * 7/2003 Morris ..... 340/628

OTHER PUBLICATIONS

Quantum Group Inc., CoStar Carbon Monoxide Safety Shutoff Model 9SS Installation and Owner's Manual, Nov. 7, 2001, 4 pages.

Quantum Group Inc., CoStar Carbon Monoxide Safety Shutoff Model 9SS product brochure, 5/97, 2 pages.

Quantum Group Inc., CoStar Carbon Monoxide (CO) Appliance Safety Shutoff (Model 9SS and Model 12/24 DSS) brochure (2 pages).

Quantum Group Inc., S34 Biomimetric Carbon Monoxide (CO) Detection Technology, Feb. 2, 2000, 72 pages.

* cited by examiner

*Primary Examiner*—Phung Nguyen
(74) *Attorney, Agent, or Firm*—Keith Frantz

(57) ABSTRACT

A proactive carbon monoxide protection system includes a carbon monoxide detector connected to a control module adapted to turn off the source of carbon monoxide, sound a central alarm, and alert an off-site monitoring station upon detection of carbon monoxide by the detector.

6 Claims, 6 Drawing Sheets

*Condition: CO Detected*

*Condition: CO Cleared*

*Condition: CO Cleared - Reset Signal*

PROACTIVE CARBON MONOXIDE MONITORING, ALARM AND PROTECTION SYSTEM

CROSS-REFERENCES TO RELATED APPLICATIONS

This application claims the priority filing date benefit of U.S. Provisional Patent Application Ser. No. 60/302,439, filed Jun. 29, 2001.

REFERENCE TO MICROFICHE APPENDIX not applicable.

STATEMENT REGARDING FEDERALLY SPONSORED RESEARCH OR DEVELOPMENT not applicable.

BACKGROUND OF THE INVENTION

1. Field of Invention

The present invention relates generally to safety equipment of a type useful in monitoring for and detecting the presence of a dangerous gas, and taking action to protect against potential injury.

More particularly, the invention relates to a proactive system which, while adaptable for other uses, is especially suitable for detecting the presence of carbon monoxide in an environment such as in a building, alerting the occupants of the building to the presence of carbon monoxide, signaling a remote monitoring station, and automatically turning-off a furnace, space heater, hot-water heater and/or other potential sources of carbon monoxide in the building.

2. Description of Prior Art

Carbon monoxide is hazardous to a person's health. When breathed, carbon monoxide replaces oxygen in the bloodstream. Mild carbon monoxide poisoning results in flu-like symptoms, while more serious poisoning leads to difficulty in breathing and even death via suffocation.

Carbon monoxide poisoning is believed to be the leading cause of accidental poisoning deaths in the United States. On the average, approximately 5,000 deaths occur, and over 20,000 illnesses result each year from carbon monoxide poisoning.

Carbon monoxide is an invisible, odorless, colorless gas that is a by-product of the incomplete combustion of fossil fuels. This makes it difficult for an individual to recognize the presence of excessive carbon monoxide.

In the home, heating and cooking equipment are common potential sources of carbon monoxide. Motor vehicles also produce carbon monoxide that can reach dangerous levels when left running in a closed or poorly ventilated garage, and can infiltrate into a home from an attached garage.

Current carbon monoxide detectors typically monitor carbon monoxide levels in one of three processes. The first process is based on electrochemical technology that uses three platinum electrodes in an electrolyte solution that generate energy when they react with the carbon monoxide, thereby setting off the alarm. The second process uses metal oxide semiconductor technology that is heated every few minutes to react with carbon monoxide and determine levels of that gas. However, this type of device requires more power than the other technologies, and thus is more expensive to operate and has a shorter life when operating on batteries. The third process uses bio-mimetic technology that is designed to mimic the hemoglobin response to carbon monoxide, which is to change to a darker color as the level of carbon monoxide increases.

These conventional detectors are provided with an internal audible alarm that sounds when the presence of carbon monoxide is detected, similar to common household fire and smoke detectors, with the intention of alerting occupants of a building to enable evacuation and/or take other corrective measures as appropriate.

However, such audible alarms can be ineffective. For example, where the detector is located remote from living spaces such as in a basement near a furnace, the alarm can be muffled, or otherwise not heard by occupants such as when sleeping. Such conventional detectors are also purely passive devices. They do not take active steps to eliminate the source of the carbon monoxide, and thus permit the continuing build-up of carbon monoxide after detection until safety personnel can arrive. Thus, there is a need for a new and improved monitoring and protection system that addresses the drawbacks and disadvantages of such prior passive devices.

SUMMARY OF THE INVENTION

The general aim of the present invention is to provide a new and improved carbon monoxide monitoring and protection system that is adapted to positively alert the occupants of a building, alert a remote monitoring system, and take proactive steps to shut-down and thereby eliminate the source of the carbon monoxide.

An objective is to achieve the foregoing by providing a system that is adapted to automatically shut-down the carbon monoxide generating source such as a furnace, space heater and/or water heater when carbon monoxide is detected in a building.

Another objective of the invention is to provide such a system that is adapted for automatic re-activation of the device when the carbon monoxide has cleared.

Yet anther objective is to provide a carbon monoxide monitoring and protection system including a controller adapted to receive carbon monoxide detection signals, and to alert a central alarm panel and/or a remote monitoring station.

Still another objective is to provide the central alarm panel and/or the remote monitoring station with indicia as to the zone of the building in which carbon monoxide was detected.

These and other objectives and advantages of the invention will become more apparent from the following detailed description when taken in conjunction with the accompanying drawings.

Briefly, a system according to the invention includes at least one carbon monoxide detector connected to a central control unit, and a central alarm system controlled by the control unit. The control unit includes a microprocessor that is programmed with appropriate functions for logic, data manipulation and data storage. The controller provides maintenance alerts, sensor data via an interface for an external hand held reader, and interface with the detectors and other external devices.

When carbon monoxide is detected, the controller turns on an audible alarm to sound in the central alarm system of the building, alerts an off-site monitoring station, and automatically shuts-down the furnace and other sources of carbon monoxide in the building. An optional audible alarm internal to the controller and/or detector also sounds to indicate the presence of carbon monoxide.

Although other type detectors may be used, one preferred system includes bio-mimetic carbon monoxide detectors that sound an alarm when low levels of carbon monoxide are detected over a pre-established period of time or high levels are detected during a shorter time. These detectors supply an alert or fault signal to the controller which then shuts down the carbon monoxide source and signals the central alarm and remote monitoring station. The carbon monoxide source shut-down is preferably accomplished by an arrangement that enables automatic re-activation of the device upon clearing of the detected carbon monoxide.

Figure 1:
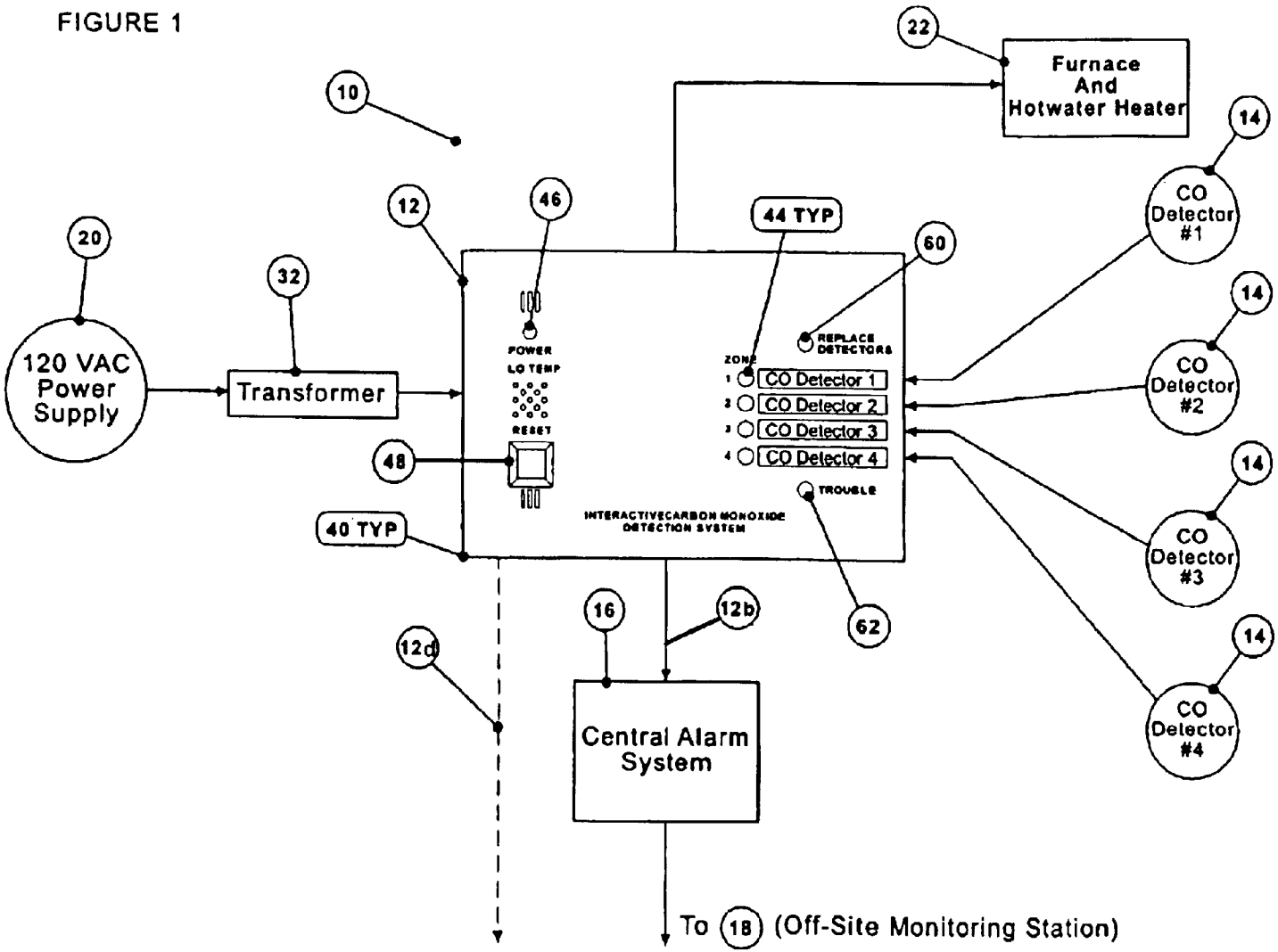
FIG. 1 is a diagrammatic representation of a new and improved proactive carbon monoxide monitoring and protection system incorporating the unique aspects of the present invention.

While the invention is susceptible of various modifications and alternative constructions, a certain illustrated embodiment has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DETAILED DESCRIPTION OF THE INVENTION

For purposes of illustration, the present invention is shown in the drawings as embodied in the carbon monoxide (CO) monitoring and protection system 10 illustrated in FIG. 1.

In accordance with the present invention, the system 10 is uniquely adapted to assist in preventing accidental carbon monoxide poisoning by detecting the presence of excessive carbon monoxide in a building, sounding an alarm to alert the occupants of the building to the presence of carbon monoxide, shutting down the source of the carbon monoxide to prevent further buildup of carbon monoxide, and optionally alerting a remote monitoring station to the presence of carbon monoxide.

Briefly, the system 10 includes a central electronic control unit 12, one or more carbon monoxide detectors 14, and a central audio alarm system 16. When a detector detects the presence of excessive carbon monoxide, it sends an alert or fault signal to the controller 12. In response to this signal, the controller activates the central alarm system to alert occupants of the building, removes power from the source of the carbon monoxide by activating a power interrupt switch mechanism relay connected to the main power line or control switch therefor, and optionally provides an off-site monitoring station 18 with a signal indicating that a carbon monoxide condition has been detected. When the excessive carbon monoxide condition has been cleared, as indicated by removal of the fault signal from the previously alerting detector, the controller turns-off the central alarm, and is adapted to restore power to the effected device by re-activating or de-energizing the relay.

Figure 6:
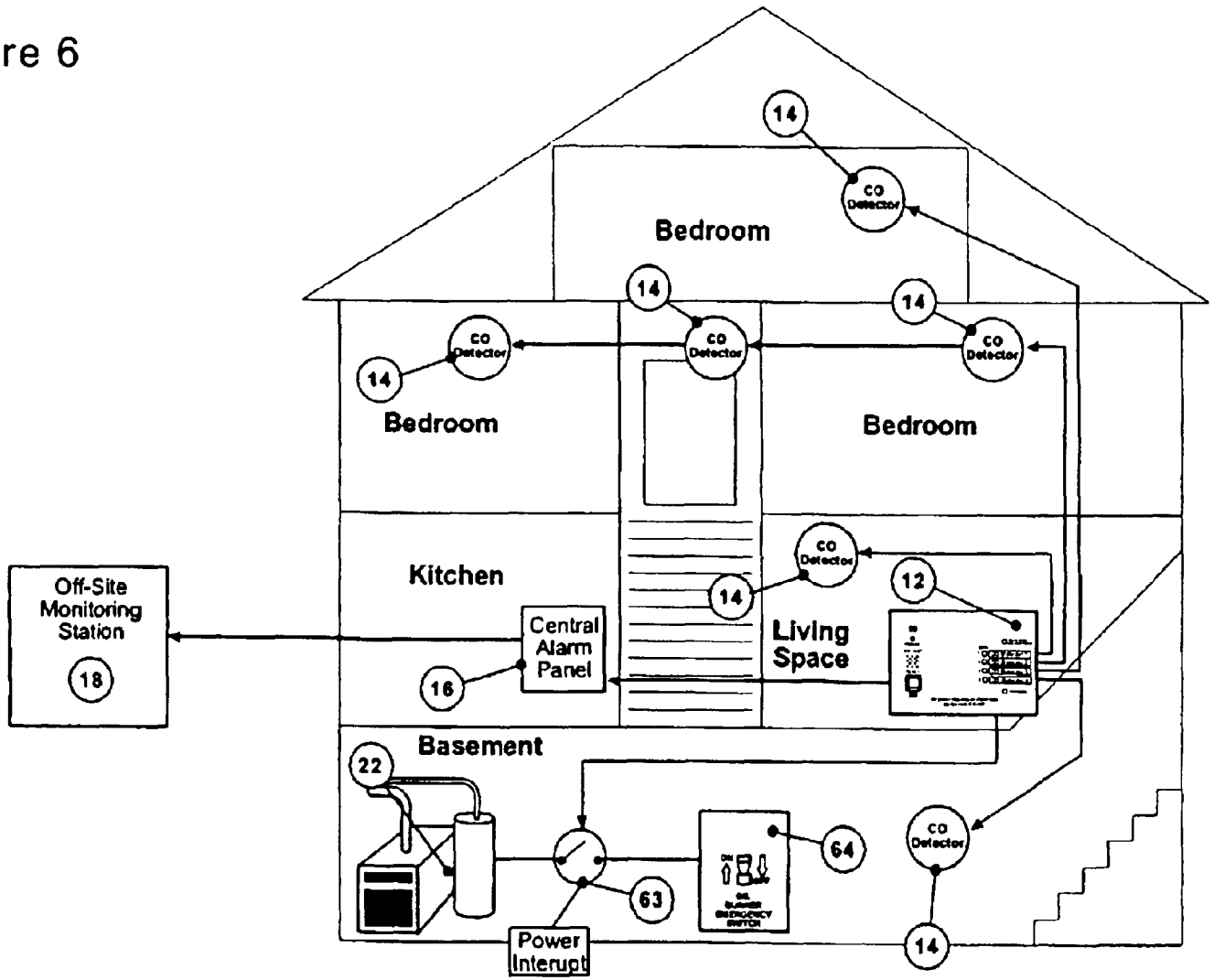
FIG. 6 is a diagrammatic representation of a typical residential installation of a carbon monoxide monitoring and protection system in accordance with the invention.

In the embodiment shown, the controller 12 is electrically connected to four carbon monoxide detectors 14 (identified as CO Detector #'s 1–4), the central alarm system 16, an electrical AC power supply 20, and the main control switch 22 of a furnace and/or water heater. In this instance, electrical power is supplied to the controller through a step-down transformer 32. Alternately, the controller may include an integral transformer or other voltage and current control circuitry for accepting available AC or DC power supply. The carbon monoxide detectors are strategically located in the building for the safety of possible occupants. For example, in a typical residential installation such as represented in FIG. 6, the detectors may be located near the furnace and water heater, in a living room, in the bedrooms, and in a garage.

Figure 2:
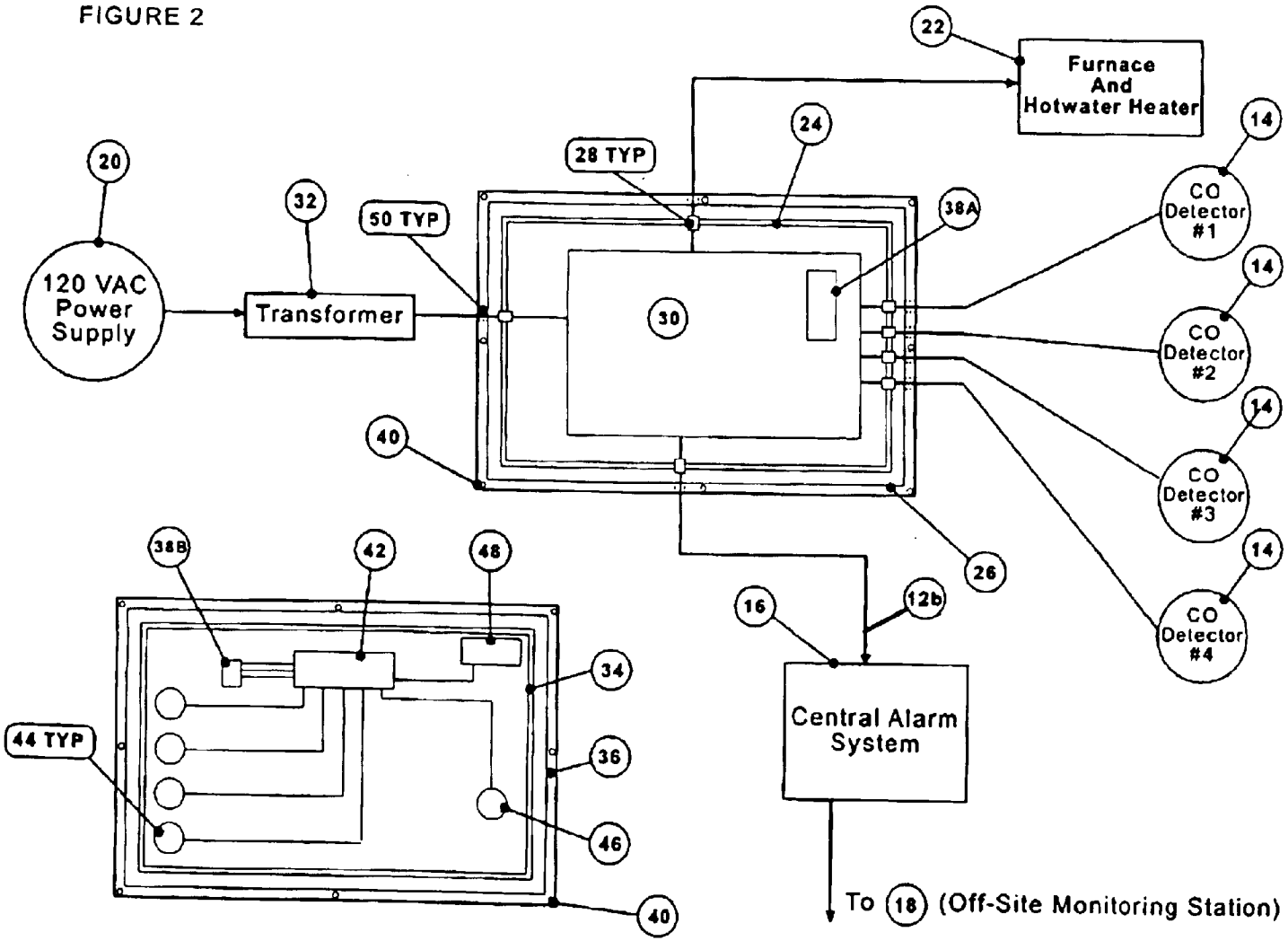
FIG. 2 is a diagrammatic representation of the system of FIG. 1, with the cover of the controller removed for viewing the inside of the cover and the inside of the controller.

As shown in FIG. 2, the controller 12 includes a master control circuit 24 located in a suitable protective housing 26 such as a plastic electrical utility box. The housing is adapted to be mounted to a wall or other stable platform such as in a location for ease of wiring to the furnace control switch 22. Knockouts 50, shown in dashed lines, are provided in the side walls of the housing to allow the wiring from the remotely located components (e.g., the carbon monoxide monitors, the central alarm system, the furnace control switch) and the electrical power supply line, to pass therethrough for connection to the master control circuit at junctions 28. A power circuit board 30 of the master control circuit 24 contains the relays, wiring connectors and necessary circuits for receiving and distributing electrical power and electrical control signals to and from the power supply and the remotely located components.

The controller 12 also includes a control module 34 circuit connected to, for example, the inside of the cover plate 36 of the housing 26. The control module circuit mates with the master control circuit 24 via mating electrical connectors 38A, 38B when the cover plate is in place on and secured to the housing such as with threaded fasteners installed into openings 40 The control circuit 34 includes a micro-processor/micro-controller module 42, carbon monoxide indicator LEDs 44, a power-on indicator LED 46, and a controller reset switch 48. Each detector LED position preferably includes a label that indicates the location of the detector in the house associated with that LED. Other audio and visual components may be provided to the control module, such as the "Replace Detectors" and "Trouble" LEDs shown in FIG. 1.

Figure 3:
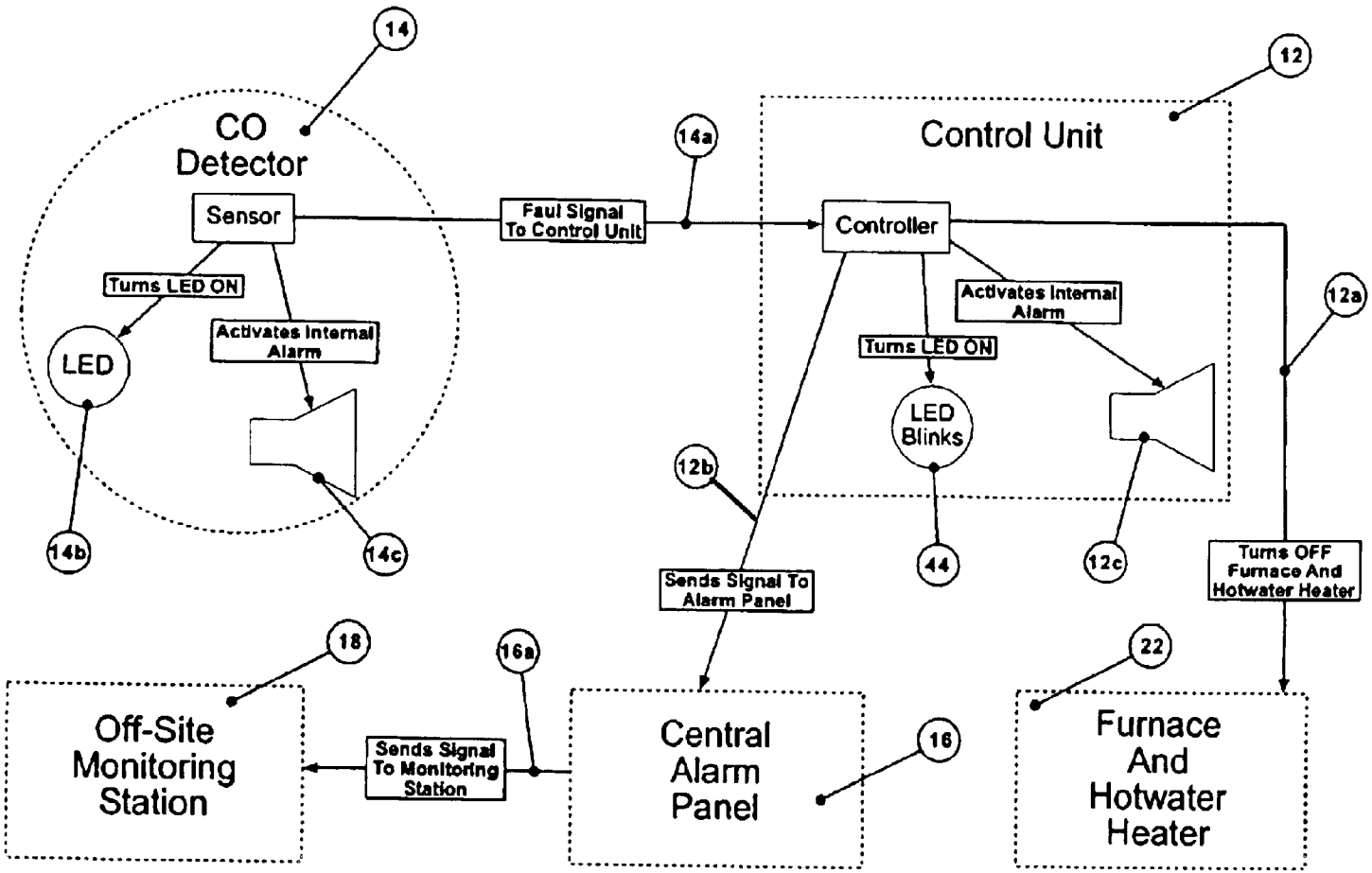
FIGS. 3–5 are diagrammatic representations of the state of the various components of the system of FIG. 1 in (i) a carbon monoxide detected condition, (ii) a carbon monoxide cleared condition, and (iii) a carbon monoxide cleared—with a reset signal condition, respectively.

Upon initial power-up of the system 10, i.e., upon application of electrical supply power to the control module 12, the carbon monoxide LEDs 44 are initially off, and the power indicator LED 46 is illuminated. As indicated in FIG. 3, if carbon monoxide is detected by one of the detectors 14, that detector sends a fault signal 14*a* to the controller 12, whereupon the controller shuts down the furnace and water heater 22 as indicated via 12*a*, sends a signal 12*b* to activate the central alarm panel 16, and causes the LED 44 associated with the alarming monitor to blink. The alarming detector and the controller optionally include internal audible alarms 14*c* and 12*c*, respectively, that are activated when carbon monoxide is detected, and the conventional detector will include an internal LED 14*b* that blinks.

Figure 4:
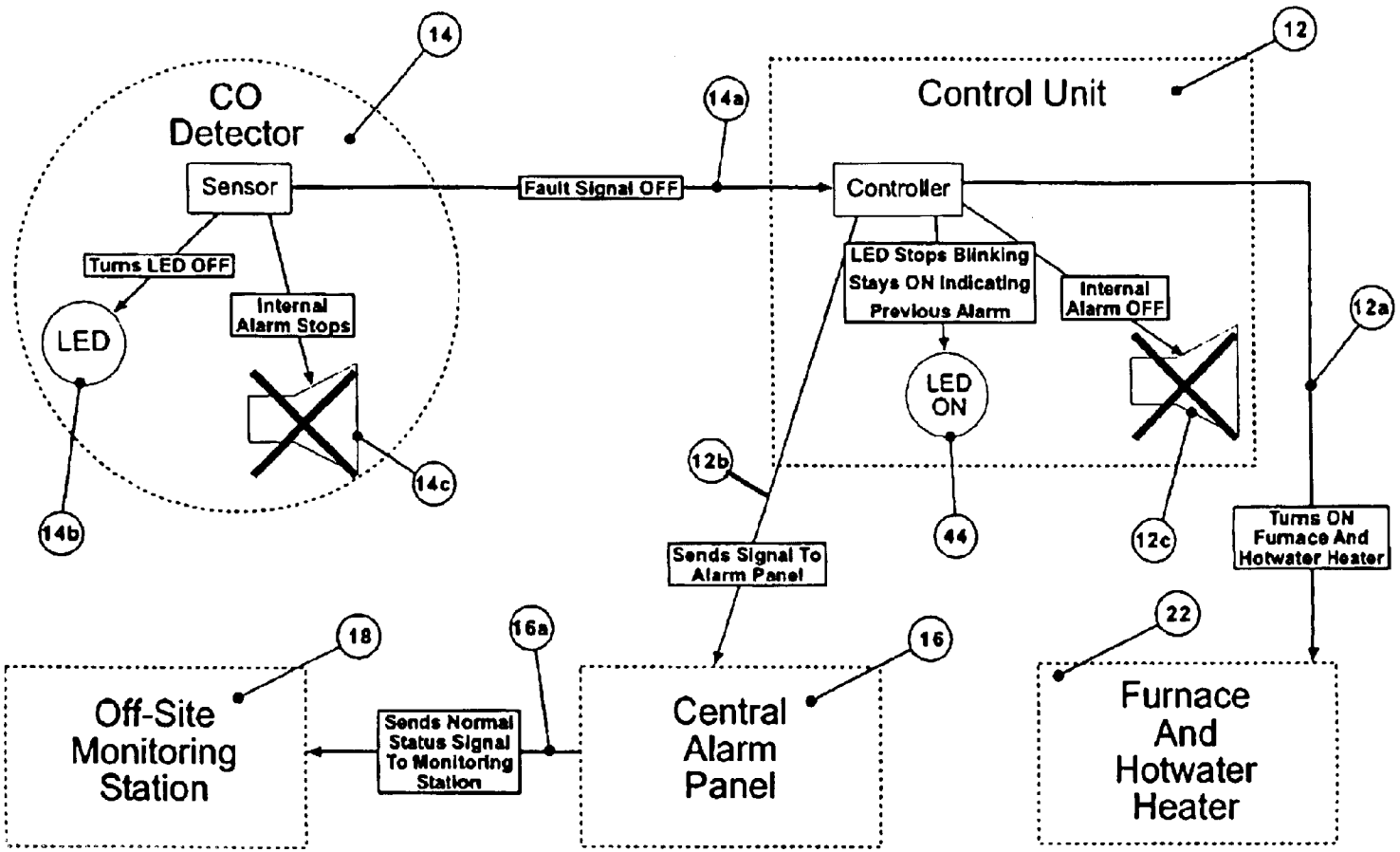
Figure 5:
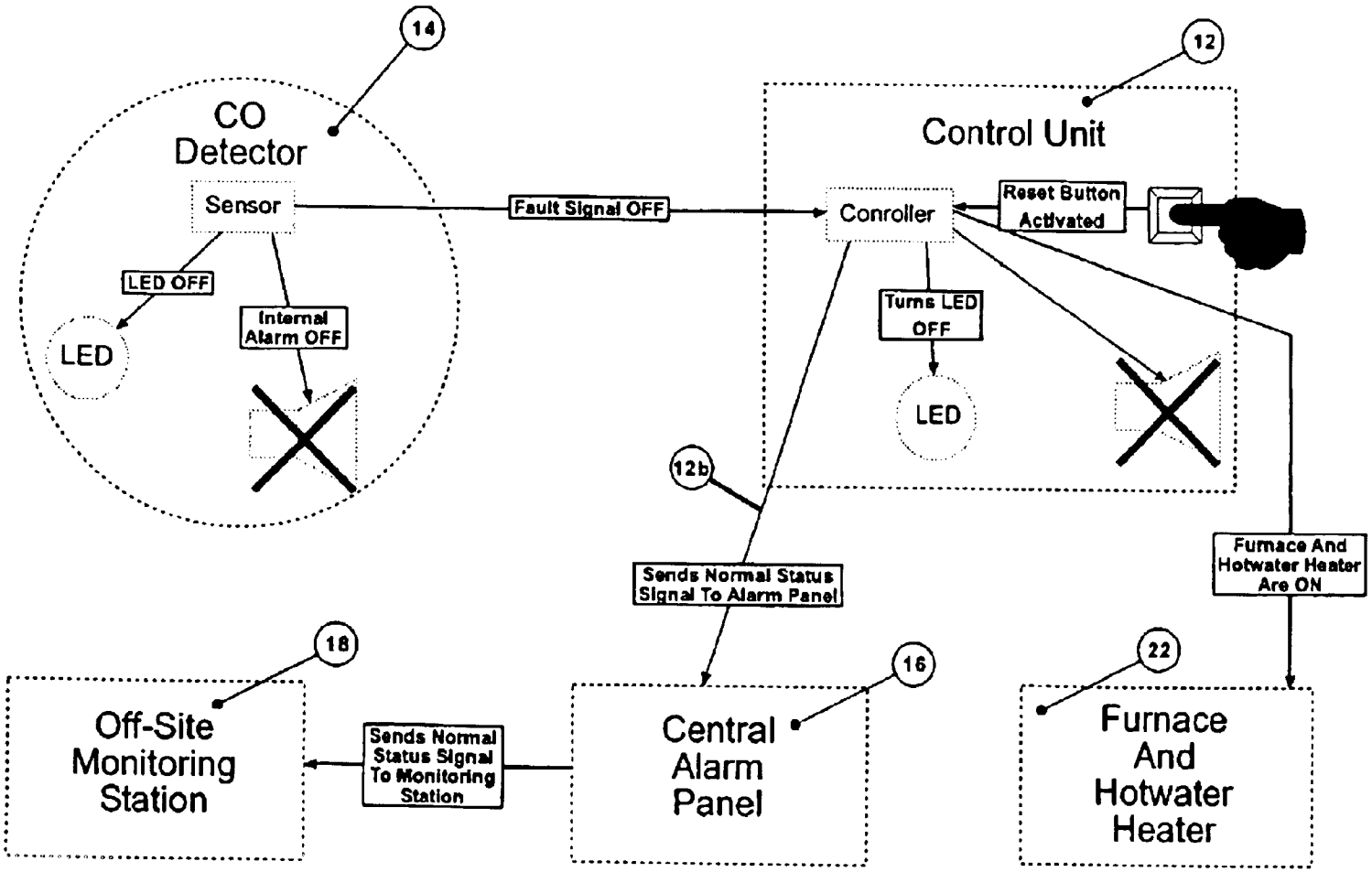

If the carbon monoxide condition clears, as indicated in FIG. 4, the fault signal 14*a* from the detector 14 ceases, whereupon the controller 12 shuts off the audio alarm and the fault signal 12*b* to the central alarm system 16, causes the LED 44 associated with that detector to change to a continuously illuminated condition, and causes the furnace and water heater to be re-activated. The LED continuously illuminated condition is a signal to the homeowner that the detector associated with that LED went into trouble mode but then cleared itself. Multiple carbon monoxide detections and fault clearing are handled in a similar fashion with continuously illuminated LEDs indicating fault areas that have cleared themselves, As illustrated in FIG. 5, a reset button 48 is used to clear the alarm system. If carbon monoxide is currently being detected, the LED 44 associated with the fault will continue to blink and the furnace and water heater will continue to be disabled. However, assuming no detectors are in a fault mode, pressing the reset button clears the steady on LEDs that had indicated carbon monoxide was detected but cleared, sends a normal status signal via 12*b* to the alarm panel, and otherwise return to the system to its normal monitoring condition. Thereafter, if an additional carbon monoxide fault is detected, the system will indicate the new fault as described above.

The system controller further includes a timer to indicate when it is time to replace the carbon monoxide detectors 14. At the end of selected term, the controller provides a reminder to replace the detectors such as the power on indicator blinking and the internal alarm chirping at periodic intervals, or in the embodiment shown, the "Replace Detectors" LED 60 will blink, providing an additional time period such as 12 months for replacement of the detectors prior to the end of their rated life. To clear and reset the timer, the reset button is pressed for a pre-established length of time such as 3 seconds.

The carbon monoxide source shut-down is preferably accomplished by an arrangement that enables re-activation of the device upon clearing of the carbon monoxide, such as actuation of a power interrupt relay inline to the source as generally disclosed in the power interruption apparatus of Clingon, U.S. Pat. No. 4,914,313, a copy of which is included herewith and is incorporated herein by reference. In this instance, furnace and water heater shut-down is accomplished by energizing a relay as indicated at 63 (FIG. 6) connected upstream or inline with a common furnace and water heater main emergency switch 64 to open the electrical line thereto. When the relay is de-energized, the electrical line closes and the furnace and water heater are automatically reactivated. This provides for a system that fails in the shut-down mode when electrical power is not available to the system. Alternately, the power interruption circuit is configured to shut-down the furnace by energizing a relay connected such that the furnace will operate in the event of loss of electrical power to the carbon monoxide protection system 10. The specific implementation will depend on the desired failure mode for the installed system. In either scenario, the main switch is maintained in the "On" position to allow the furnace and water heater to restart when the carbon monoxide condition is cleared and the fault signal has ceased.

The central alarm system 16 is configured to communicate with the off-site monitoring station 18. Upon receipt of the carbon monoxide fault signal 12*b* from the controller 12 (FIG. 3), the alarm system automatically dials the monitoring station as indicated at 16*a* and reports the fault condition where the fault type is determined and appropriate action is taken. As usual, action at the remote site station will depend upon the circumstances, such as location and/or duration of the alert signal, and may include notifying the fire department or investigative officers and calling the residents of the home or management of a commercial building. When the fault signal ceases from the detector (FIG. 4), the alarm system sends a "Normal Status" signal to the remote monitoring station. The signal 12*b* from the controller 12 to the alarm system 16 is preferably a form capable of indicating that a carbon monoxide fault has been detected and in which detector, such as utilizing a "C" switch closure or providing a separate output for each detector input. If the alarm system and/or off-site monitoring station cannot handle or distinguish multiple fault lines, the controller output signals are bussed together to provide only one fault signal line. Alternately, the controller is configured to automatically alert the off-site monitoring station, bypassing the central alarm as indicated by the dashed signal line 12*d* in FIG. 1. In preferred embodiments, the system 10 is further provided with an alphanumeric keypad connected to the alarm panel and/or controller and operable for setting the various control parameters of the system.

The system controller 12 may also be adapted for additional sensing and alerting functions. For example, in certain embodiments, the controller (i) is wired to detect an interruption of the furnace power supply, and to send an alert signal to the central alarm 16 in the event of loss of power, (ii) is wired to one or more room temperature sensors to detect the inside air temperature, and to send an alert signal to the central alarm in the event the temperature drops below a pre-established temperature, and/or is wired to fire detectors to send an alert signal to the alarm panel in the event of a fire-indicative fault signal. In such instances, the controller is provided with associated audio/visual indicia which blinks during a fault detected condition, and remains continuously illuminated between the time when fault has been cleared and the system reset, such as the Power light 46 blinking or as generally indicated with LED 62.

As will be evident from the foregoing, the carbon monoxide protection system 10 is equally suitable for use in locations other than buildings. By way of example only, the system 10 may be installed into appropriate locations in various marine applications such as barges, oil tankers and cruise liners.

As further example, the detectors 14 may be mounted at locations in a building near additional appliances or equipment that could potentially generate carbon monoxide. For example, carbon monoxide detectors may be located in a garage and/or near a space heater. In such instances, the controller is connected to the main control switches or power supply lines to each of the potential carbon monoxide sources, and is adapted to selectively disable each device as well as the furnace and/or water heater, and/or open the garage door according to which detector sends an alert signal indicating the presence of carbon monoxide and depending upon how the system is programmed.

In other alternate embodiments, the system 10 is not connected to the remote monitoring site 18, but is a stand-alone system, or is configured to not automatically reactivate the furnace upon clearing of the carbon monoxide. Additional optional aspects of the system 10 include the controller being adapted to report when a temporary loss of power occurred, as well as reporting other status aspects and parameters of the system and various components, and the results of diagnostic tests therefor, with associated audio/visual indicia such as generally indicated as LED 62.

In yet another alternate embodiment, the system 10 includes one or more clusters of carbon monoxide detectors, with each cluster of detectors being connected to the controller 12 such as cascaded or through a buss terminating in a single-wire, that forwards a single alert signal to the controller in the event any detector in the cluster detects carbon monoxide. With this arrangement, a single controller with, for example, only four detector "portals" in the configuration shown in FIGS. 1 and 2, can handle potential alert signals from many detectors in four clusters or zones in a building. In this instance, each controller input is considered a separate zone that corresponds to a specific zone alarm output and alert LED, with the operation of the controller being as described above. Such arrangement is particularly useful in larger commercial or rental buildings, with clusters of detectors being provided on each floor or for one floor-area of the building. One such arrangement is shown in FIG. 6 in which three detectors establish a second floor detection zone in a residence, and are connected to the controller through a single portal, the other zones of detection being established in the basement, on the first floor of the residence, and in an additional bedroom.

From the foregoing, it will be apparent that the present invention brings to the art a new and improved carbon monoxide protection system which, by virtue of the ability to clearly alert occupants of a carbon monoxide condition, and take action to eliminate the potentially dangerous condition, or at the least, eliminate additional buildup of carbon monoxide, the system is uniquely adapted to assist in preventing accidental poisoning from carbon monoxide.

We claim:

1. A carbon monoxide monitoring and protection system for use with a potential carbon monoxide generating source controlled by an electrical line thereto, the system comprising:

carbon monoxide detectors operative to provide a fault signal upon detection of carbon monoxide and to discontinue the fault signal upon clearing of the detected carbon monoxide;

a controller connected to said detectors to receive said fault signal;

the controller being further connected to the electrical line and operative to (i) automatically interrupt said electrical line and thereby shut-down operation of the potential carbon monoxide generating source in response to said fault signal, and (ii) automatically discontinue interruption of said electrical line and thereby automatically restore operation of the potential carbon monoxide generating source upon discontinuation of said fault signal;

identifying indicia associated with said detectors, said indicia having (i) a normal condition, (ii) an alert condition responsive to said fault signal, and (iii) an alert-cleared condition automatically responsive to discontinuation of said fault signal, said alert-cleared condition being readily visible and distinguishable from said normal and alert conditions; and a reset module connected to said indicia and operative to return said indicia from said alert-cleared condition to said normal condition.

2. The carbon monoxide monitoring and protection system as defined in claim 1 further comprising a switch mechanism connected to said electrical line and the controller and responsive thereto to interrupt said electrical line and thereby shut-down the potential carbon monoxide generating source.

3. The carbon monoxide monitoring and protection system as defined in claim 2 in which said switch mechanism comprises a relay connected to said electrical line and the controller and responsive thereto to interrupt said electrical line and thereby shut-down the potential carbon monoxide generating source.

4. The carbon monoxide monitoring and protection system as defined in claim 3 in which the relay is normally de-energized to establish electrical continuity in said electrical line, and the controller is operative to energize the relay and establish an electrical open in said electrical line in response to said signal from one of said detectors so as to interrupt said electrical line and thereby shut-down operation of the potential carbon monoxide generating source.

5. The carbon monoxide monitoring and protection system as defined in claim 1 further comprising a central alarm module connected to said controller, and in which said controller is further connected to and operative to (i) alert a remote monitoring station and (ii) activate said central alarm module, in response to said signal from said one detector.

6. A carbon monoxide monitoring and protection system for use with a potential carbon monoxide generating source controlled by an electrical line thereto, the system comprising:

carbon monoxide detectors operative to provide a fault signal upon detection of carbon monoxide and to discontinue said fault signal upon clearing of the detected carbon monoxide;

illuminating indicia associated with said detectors, said indicia having a normal condition;

a controller connected to said detectors and said illuminating indicia and operative to (i) automatically illuminate said indicia from said normal condition into a perceptibly distinguishable alert condition and automatically interrupt said electrical line to shut-down operation of the potential carbon monoxide generating source in response to a fault signal associated with detection of carbon monoxide, and (ii) automatically illuminate said indicia from said alert condition into a perceptibly distinguishable alert-cleared condition and automatically discontinue interruption of said electrical line to automatically restore operation of the potential carbon monoxide generating source upon discontinuation of said fault signal associated with clearing of the detected carbon monoxide; and a reset module operative to return said indicia from said alert-cleared condition to said normal condition.

* * * * *